US011752782B2

(12) United States Patent
Asada et al.

(10) Patent No.: US 11,752,782 B2
(45) Date of Patent: Sep. 12, 2023

(54) HEATING DEVICE, LIQUID DISCHARGE APPARATUS, AND PRINTER

(71) Applicants: Kohki Asada, Tokyo (JP); Kenji Nozawa, Kanagawa (JP); Kazuaki Kamihara, Tokyo (JP); Genichiroh Kawamichi, Ibaraki (JP); Ryusaku Hida, Kanagawa (JP)

(72) Inventors: Kohki Asada, Tokyo (JP); Kenji Nozawa, Kanagawa (JP); Kazuaki Kamihara, Tokyo (JP); Genichiroh Kawamichi, Ibaraki (JP); Ryusaku Hida, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/748,034

(22) Filed: May 19, 2022

(65) Prior Publication Data

US 2022/0402280 A1 Dec. 22, 2022

(30) Foreign Application Priority Data

Jun. 16, 2021 (JP) ..... 2021-100539

(51) Int. Cl.
*B41J 11/00* (2006.01)

(52) U.S. Cl.
CPC ..... *B41J 11/00222* (2021.01)

(58) Field of Classification Search
CPC ..... B41J 11/00222; B41J 11/0022
See application file for complete search history.

(56) References Cited

U.S. PATENT DOCUMENTS

| | | | |
|---|---|---|---|
| 2016/0273832 | A1 | 9/2016 | Asada et al. |
| 2017/0266987 | A1 | 9/2017 | Asada et al. |
| 2017/0266988 | A1 | 9/2017 | Asada et al. |
| 2017/0266989 | A1 | 9/2017 | Ogawa et al. |
| 2017/0334218 | A1 | 11/2017 | Ogawa et al. |
| 2018/0016106 | A1 | 1/2018 | Asada et al. |
| 2018/0147878 | A1 | 5/2018 | Asada et al. |
| 2018/0264852 | A1 | 9/2018 | Ohtake et al. |
| 2019/0202215 | A1 | 7/2019 | Asada et al. |
| 2019/0204767 | A1 | 7/2019 | Ishihara et al. |
| 2020/0290383 | A1 | 9/2020 | Ishihara et al. |
| 2021/0031542 | A1 | 2/2021 | Kamihara et al. |
| 2021/0197584 | A1 | 7/2021 | Asada et al. |
| 2021/0221149 | A1 | 7/2021 | Nakamura et al. |
| 2021/0370692 | A1 | 12/2021 | Sawase et al. |
| 2022/0063300 | A1 | 3/2022 | Asada et al. |
| 2022/0066361 | A1 | 3/2022 | Shimojima et al. |
| 2022/0111663 | A1* | 4/2022 | Kamihara ..... B41J 11/00216 |

FOREIGN PATENT DOCUMENTS

| | | |
|---|---|---|
| JP | 8-110629 | 4/1996 |
| JP | 2019-166666 | 10/2019 |
| JP | 2021-024181 | 2/2021 |

* cited by examiner

*Primary Examiner* — Bradley W Thies
(74) *Attorney, Agent, or Firm* — XSENSUS LLP

(57) ABSTRACT

A heating device includes a blower configured to blow air, the blower comprising a channel member defining a channel of the air, and a heater disposed outside the channel member. The channel member has end portions and a central portion in a longitudinal direction, each of the end portions having higher heat absorption property than the central portion, and said each of end portions of the channel member faces the heater.

13 Claims, 9 Drawing Sheets

HEATING DEVICE, LIQUID DISCHARGE APPARATUS, AND PRINTER

CROSS-REFERENCE TO RELATED APPLICATIONS

This patent application is based on and claims priority pursuant to 35 U.S.C. § 119(a) to Japanese Patent Application No. 2021-100539, filed on Jun. 16, 2021, in the Japan Patent Office, the entire disclosure of which is hereby incorporated by reference herein.

BACKGROUND

Technical Field

Aspects of the present disclosure relate to a heating device, a liquid discharge apparatus, and a printer.

Related Art

A printer applies a liquid onto a printing object such as a sheet to perform a printing operation. The printer includes a heater to heat the sheet onto which a liquid has been applied to promote drying of the liquid applied onto the sheet.

The printer includes a dryer that includes a single intake duct between a pair of hot-blowers. The intake duct is coupled to and communicated with one end of the blowing duct of the pair of hot-blowers. The dryer collects hot air by the single intake duct so that a drying degree in a width direction of a continuous sheet on a conveyance path, onto which the hot air is blown from a blowing port, is made substantially uniform.

SUMMARY

In an aspect of this disclosure, A heating device includes a blower configured to blow air, the blower comprising a channel member defining a channel of the air, and a heater disposed outside the channel member. The channel member has end portions and a central portion in a longitudinal direction, each of the end portions having higher heat absorption property than the central portion, and said each of end portions of the channel member faces the heater.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
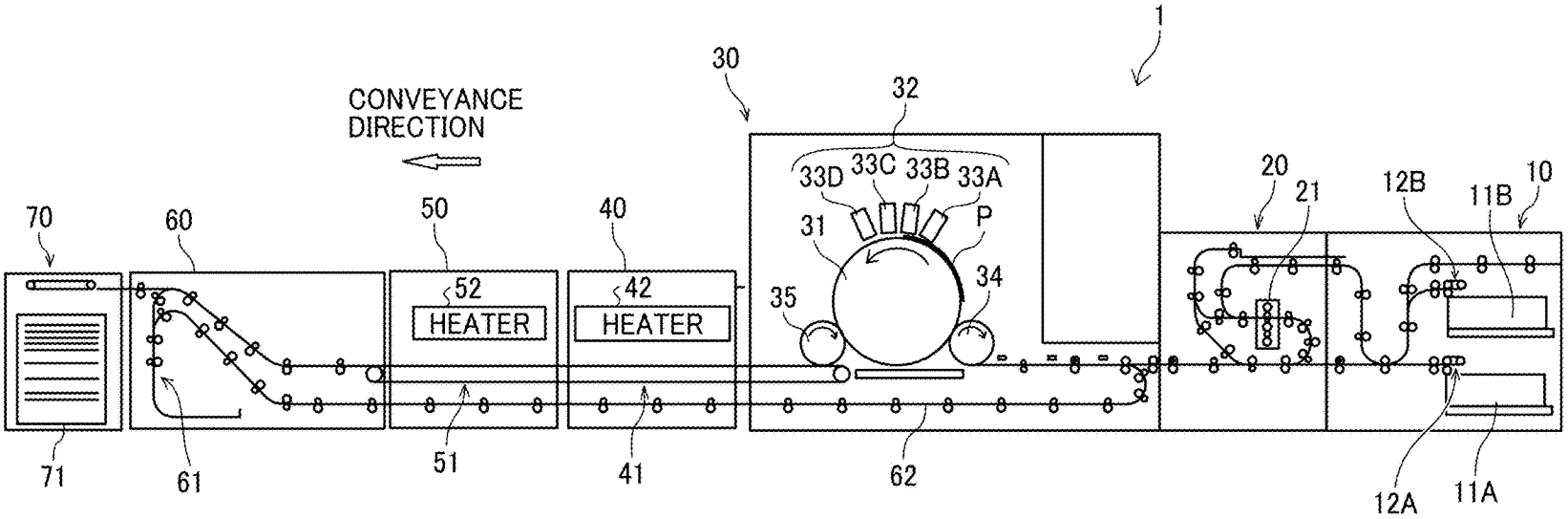
FIG. 1 is a schematic cross-sectional side view of a printer as a liquid discharge apparatus according to a first embodiment of the present disclosure.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a", "an", and "the" are intended to include the plural forms as well, unless the context clearly indicates otherwise.

It will also be understood that when an element is referred to as being "connected" or "coupled" to another element, it can be directly connected or coupled to another element or intervening elements may be present.

In contrast, when an element is referred to as being "directly connected" or "directly coupled" to another element, there are no intervening elements present. Referring now to the drawings, wherein like reference numerals designate identical or corresponding parts throughout the several views, embodiments of the present disclosure are described below.

Referring now to the drawings, wherein like reference numerals designate identical or corresponding parts throughout the several views, embodiments of the present disclosure are described below. A printer 1 as a liquid discharge apparatus according to a first embodiment of the present disclosure is described with reference to FIGS. 1 and 2.

FIG. 1 is a schematic cross-sectional side view of the printer 1 according to the first embodiment of the present disclosure.

Figure 2:
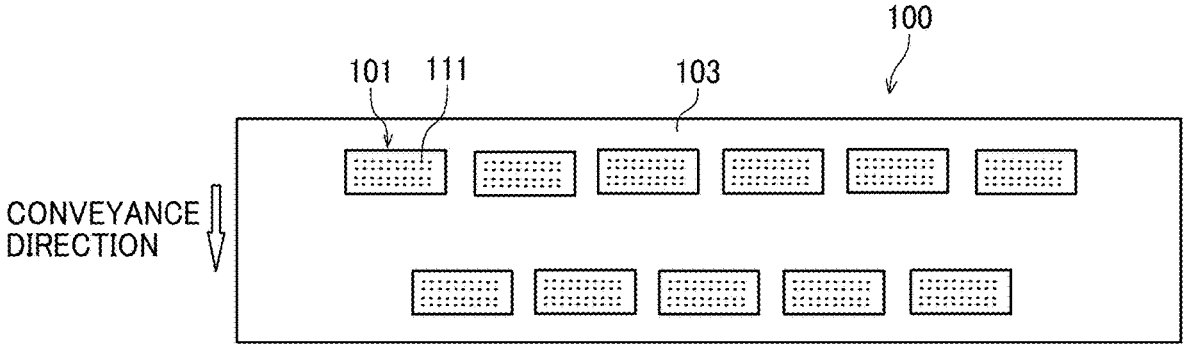
FIG. 2 is a plan view of a discharge unit of the printer.

FIG. 2 is a schematic plan view of a discharge unit 33 of the printer 1.

The printer 1 according to the first embodiment includes a loading unit 10 to load a sheet P into the printer 1, a pretreatment unit 20, a printing unit 30, a first dryer 40 and a second dryer 50, a reverse mechanism 60, and an ejection unit 70. The pretreatment unit 20 serves as a coater to apply (coat) a pretreatment liquid onto the sheet P.

In the printer 1, the pretreatment unit 20 applies, as desired, a pretreatment liquid as an application liquid onto the sheet P fed (supplied) from the loading unit 10, and the printing unit 30 applies a desired liquid onto the sheet P to perform desired printing.

After the printer 1 dries the liquid adhering to the sheet P by the first dryer 40 and the second dryer 50, the printer 1 ejects the sheet P to the ejection unit 70 through the reverse mechanism 60 without printing on a back surface of the sheet P. The printer 1 may print on both sides of the sheet P via the reversing mechanism 60 after the printer 1 dries the liquid adhering to the sheet P by the first dryer 40 and the second dryer 50, and the printer 1 then ejects the sheet P to the ejection unit 70.

The loading unit 10 includes loading trays 11 (a lower loading tray 11A and an upper loading tray 11B) to accommodate multiple sheets P and feeding devices 12 (a feeding device 12A and a feeding device 12B) to separate and feed the multiple sheets P one by one from the loading trays 11, and supplies the sheet P to the pretreatment unit 20.

The pretreatment unit 20 includes, e.g., a coater 21 as a treatment-liquid application unit that coats a printing surface of the sheet P with a treatment liquid having an effect of aggregation of ink particles to prevent bleed-through.

The printing unit 30 includes a drum 31 and a liquid discharge device 32. The drum 31 is a bearer (rotator) that bears the sheet P on a circumferential surface of the drum 31 and rotates. The liquid discharge device 32 discharges liquid toward the sheet P borne on the drum 31.

The printing unit 30 includes transfer cylinders 34 and 35. The transfer cylinder 34 receives the sheet P fed from the pretreatment unit 20 and forwards the sheet P to the drum 31. The transfer cylinder 35 receives the sheet P conveyed by the drum 31 and forwards the sheet P to the first dryer 40.

The transfer cylinder 34 includes a sheet gripper to grip a leading end of the sheet P conveyed from the pretreatment unit 20 to the printing unit 30. The sheet P thus gripped by the transfer cylinder 34 is conveyed as the transfer cylinder 34 rotates. The transfer cylinder 34 forwards the sheet P to the drum 31 at a position opposite (facing) the drum 31.

Similarly, the drum 31 includes a sheet gripper on a surface of the drum 31, and the leading end of the sheet P is gripped by the sheet gripper of the drum 31. The drum 31 includes a plurality of suction holes dispersed on a surface of the drum 31, and a suction unit generates suction airflows directed from desired suction holes of the drum 31 to an interior of the drum 31. The suction unit may be disposed inside the drum 31. The suction unit may also be coupled to the drum 31 with a tube and the like.

The sheet gripper of the drum 31 grips the leading end of the sheet P forwarded from the transfer cylinder 34 to the drum 31, and the sheet P is attracted to and borne on the drum 31 by the suction airflows by the suction device. As the drum 31 rotates, the sheet P is conveyed.

The liquid discharge device 32 includes discharge units 33 (discharge units 33A to 33D) to discharge liquids onto the sheet P as a liquid application unit. For example, the discharge unit 33A discharges a liquid of cyan (C), the discharge unit 33B discharges a liquid of magenta (M), the discharge unit 33C discharges a liquid of yellow (Y), and the discharge unit 33D discharges a liquid of black (K). Further, the discharge unit 33 may discharge a special liquid, that is, a liquid of spot color such as white, gold, or silver.

As illustrated in FIG. 2, for example, each of the discharge unit 33 includes a head module 100 including a full-line head. The head module 100 includes multiple liquid discharge heads 101 arranged in a staggered manner on a base 103. Each of the liquid discharge heads 101 includes multiple nozzle arrays, and multiple nozzles 111 are arranged in each of the nozzle arrays. Hereinafter, the "liquid discharge head 101" is simply referred to as a "head 101".

The printing unit 30 controls a discharge operation of each discharge unit 33 of the liquid discharge device 32 by a drive signal corresponding to print data. When the sheet P borne on the drum 31 passes through a region facing the liquid discharge device 32, the liquids of respective colors are discharged from the discharge units 33 toward the sheet P. and an image corresponding to the print data is printed on the sheet P.

The first dryer 40 includes a heater 42 such as an infrared (IR) heater. The heater 42 of the first dryer 40 irradiates the sheet P, onto which the liquid has been applied, with infrared rays to heat and dry the sheet P conveyed by the conveyor 41. The second dryer 50 includes a heater 52 such as an ultraviolet (UV) ray irradiator. The heater 52 of the second dryer 50 irradiates the sheet P, to which the liquid has been applied, with ultraviolet rays to heat and dry the sheet P passed through the first dryer 40 and conveyed by a conveyor 51. The conveyor 41 and the conveyor 51 may include a part of the same conveyance mechanism. The conveyor 41 and the conveyor 51 convey the sheet P in a conveyance direction as indicated by arrow in FIG. 1.

The reverse mechanism 60 includes a reverse path 61 and a duplex path 62. The reverse path 61 reverses the sheet P that has passed through the first dryer 40 and the second dryer 50 to dry one surface of the sheet P onto which the liquid has been applied when the printer 1 performs a duplex printing. The duplex path 62 feeds the reversed sheet P back to upstream (right side in FIG. 1) of the transfer cylinder 34 of the printing unit 30. The reverse path 61 reverses the sheet P by switchback manner.

The ejection unit 70 includes an ejection tray 71 on which the multiple sheets P are stacked. The multiple sheets P conveyed from the reverse mechanism 60 are sequentially stacked and held on the ejection tray 71.

In the present embodiment, an example in which the sheet P is a cut sheet is described. However, embodiments of the present disclosure can also be applied to an apparatus using a continuous medium (web) such as continuous paper or roll paper, an apparatus using a sheet such as wallpaper, and the like.

A dryer 400 including a heater 42 according to the first embodiment of the present disclosure is described with reference to FIG. 3.

Figure 3:
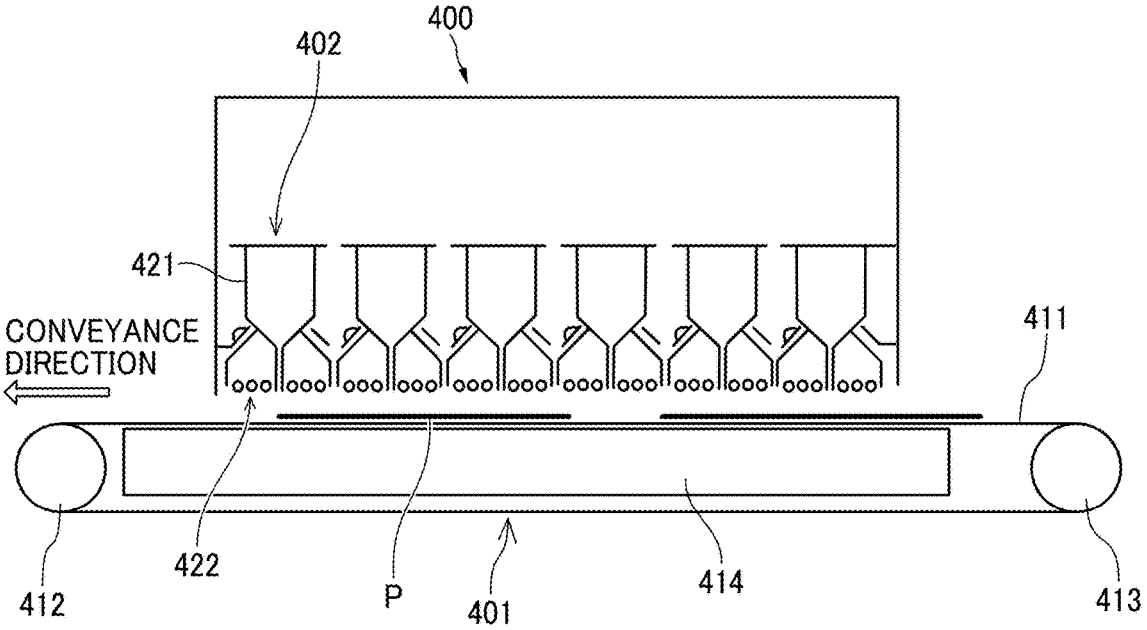
FIG. 3 is a schematic cross-sectional side view of a dryer according to the first embodiment of the present disclosure.

FIG. 3 is a schematic cross-sectional side view of the dryer 400 according to the first embodiment of the present disclosure.

The dryer 400 includes a conveyance mechanism 401 as a conveyor and one or more heating device 402 according to the present disclosure. The dryer 400 forms the first dryer 40, and one or more of the heating devices 402 forms the heater 42.

The conveyance mechanism 401 includes a conveyance belt 411 that bears and conveys the sheet P in the conveyance direction. The conveyance mechanism 401 serves as a "conveyor".

The conveyance belt 411 is an endless belt stretched between a drive roller 412 and a driven roller 413. The conveyance belt 411 rotates to move the sheet P. The conveyance mechanism 401 according to the first embodiment includes a mechanism to convey the sheet P from the printing unit 30 to the reverse mechanism 60 across the first dryer 40 and the second dryer 50 as illustrated in FIG. 1.

The conveyance belt 411 is a belt that includes multiple openings from which an air is sucked by a suction chamber 414 disposed inside the conveyance belt 411. The conveyance belt 411 may be, for example, a mesh belt, a flat belt having suction holes, or the like. The suction chamber 414 includes a suction blower, a fan, or the like to sucks the air through the multiple openings in the conveyance belt 411 to attract the sheet P to the conveyance belt 411. The conveyor (conveyance mechanism 401) is not limited to the conveyor that uses suction method to attract and convey the sheet P as described above. For example, the conveyance mechanism 401 (conveyor) may convey the sheet P by an electrostatic attraction method, a gripping method using a gripper, or the like.

The heating device 402 blows hot air onto the sheet P conveyed by the conveyance mechanism 401 and irradiates the sheet P with infrared rays to heat the sheet P.

The heating device 402 according to the first embodiment of the present disclosure is described with reference to FIGS. 4 to 7.

Figure 4:
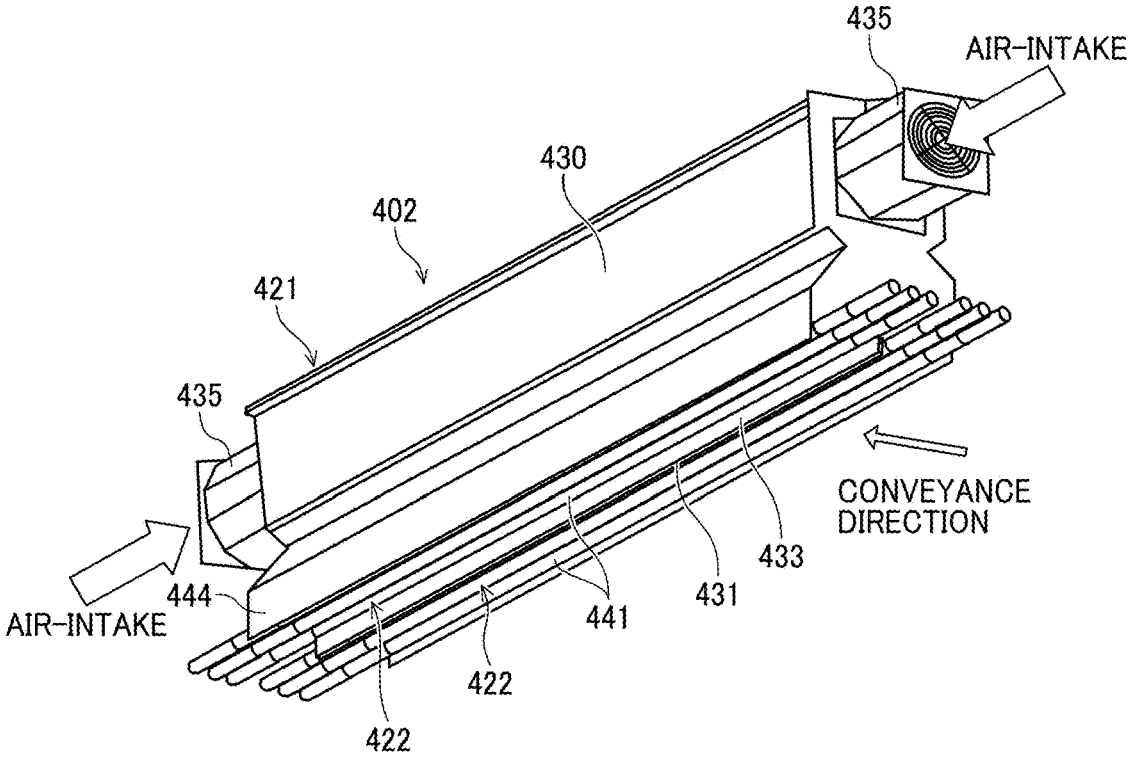
FIG. 4 is a schematic perspective view of the heating device according to the first embodiment.

FIG. 4 is a schematic perspective view of the heating device 402 according to the first embodiment.

Figure 5:
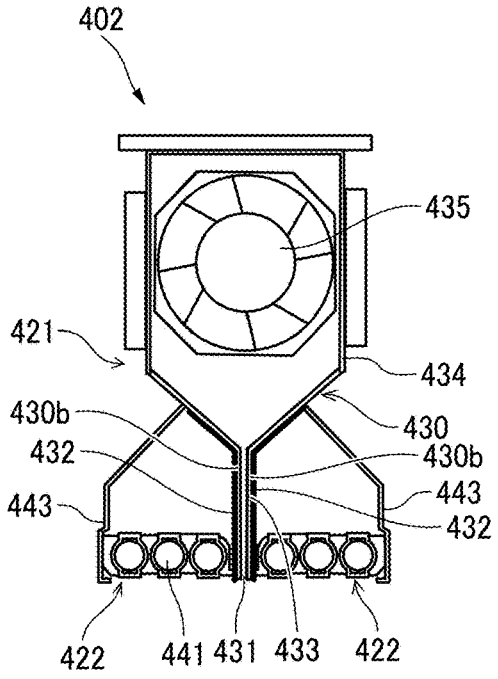
FIG. 5 is a schematic cross-sectional side view the heating device of FIG. 4.

FIG. 5 is a schematic cross-sectional side view the heating device 402 of FIG. 4.

Figure 6:
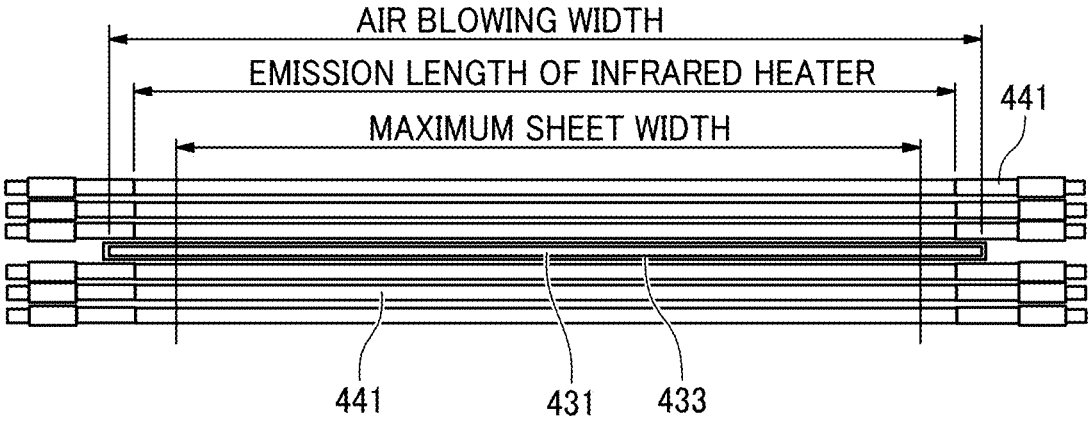
FIG. 6 is a schematic plan view of the heating device of FIG. 4.

FIG. 6 is a schematic plan view of the heating device 402 of FIG. 4.

Figure 7:
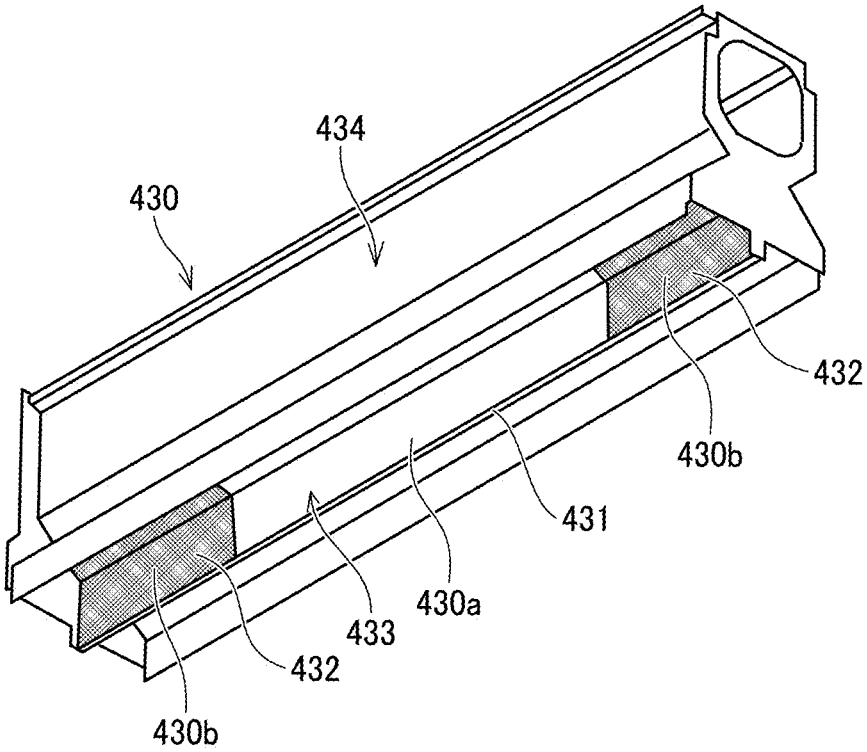
FIG. 7 is a schematic cross-sectional side view of a channel member of the heating device of FIG. 4.

FIG. 7 is a schematic cross-sectional side view of a channel member of the heating device 402 of FIG. 4.

The heating device 402 is a heater including a blower 421 and a heater 422. The blower 421 and the heater 422 are modularized.

The blower 421 is an air knife serving as a gas blower to blow air to the sheet P. The blower 421 includes a channel member 430 that forms a channel through which the air blown by the blower 421 passes. The channel member 430 includes a nozzle 433 having a slit-shaped blowing port 431 and a chamber 434 through which the blowing port 431 communicates.

Multiple sheet metal members are combined to form the channel member 430. The blowing port 431 may have a shape in which multiple openings are arrayed in a row. Although the channel member 430 has the blowing port 431 in the present embodiment, the channel member 430 and the blowing port 431 may be formed by different members.

Here, a "longitudinal direction" is a direction coincident with (along) a length of the channel member 430. That is, the longitudinal direction is a direction orthogonal to a width direction of the sheet P in the first embodiment. In other words, the longitudinal direction is a direction crossing (intersecting) the conveyance direction of the sheet P.

Note that a longitudinal direction of the channel member 430 is coincident with (parallel to) a longitudinal direction of the blowing port 431.

Therefore, the blower 421 is disposed such that the channel member 430 and the blowing port 431 extend along the width direction of the sheet P.

The channel member 430 includes intake fans 435 as an intake that intakes air into the chamber 434. The intake fan 435 is attached to each end of the channel member 430 in the longitudinal direction. Air taken into the chamber 434 by the intake fans 435 generates an airflow flowing in the longitudinal direction in the chamber 434.

The heater 422 includes multiple infrared irradiators 441 arrayed in an upstream and a downstream of the nozzle 433 of the blower 421 in the conveyance direction of the sheet P. The longitudinal direction of the multiple infrared irradiators 441 is coincident with (parallel to) a longitudinal direction of the blower 421. Each of the multiple infrared irradiators 441 include infrared (IR) heater, for example. The multiple infrared irradiators 441 of each of the heaters 422 are arrayed in the conveyance direction of the sheet P. Further, a longitudinal direction of each of the multiple infrared irradiators 441 (heater 422) is coincident with (parallel to) a longitudinal direction of the blowing port 431 (channel member 430).

The heater 422 is covered by a cover 443 (see FIG. 5) attached to the channel member 430 of the blower 421. Both ends of the infrared irradiator 441 of the heater 422 are held by a bracket attached to the channel member 430.

As illustrated in FIG. 6, both end positions of the blowing port 431 of the nozzle 433 of the blower 421 are respectively disposed outside both end positions of a heat radiation region of the infrared irradiator 441 in the longitudinal direction of the channel member 430 (blower 421). Both end positions of the blowing port 431 of the nozzle 433 correspond to both end positions of an air blowing width of the blowing port 431. The heat radiation region corresponds to an emission length of the infrared heater.

Similarly, both end positions of the heat radiation region (emission length of the infrared heater) of the infrared irradiator 441 are respectively disposed outside both end positions of the maximum sheet width of the sheet P to be heated in the longitudinal direction of the blower 421 (channel member 430). If a length of a light emission portion of an irradiating heater of the infrared irradiator 441 is long, heat may be excessively transmitted to an operating portion or the like. For example, the air blowing width (air knife width) is 678 mm, the emission length of the infrared heater is 644 mm, and the maximum sheet width is 585 mm in the first embodiment.

As illustrated in FIG. 7, heat absorption property of each end portions 430*b* of the channel member 430 in a longitudinal direction of the blower 421 (channel member 430) is made higher than heat absorption property of a central portion 430*a* of the channel member 430. The central portion 430*a* of the channel member 430 includes a center of the channel member 430 in the longitudinal direction of the channel member 430. Each end portions 430*b* of the channel member 430 faces the heater 422 of the channel member 430

Specifically, an outer wall surface of the end portion 430*b* of the channel member 430 is blackened as a blackened surface 432. A color of the central portion 430*a* is a background color of the sheet metal member that forms the channel member 430. The background color of the sheet metal member forming the channel member 430 of the first embodiment is a color that reflects infrared rays.

In the dryer 400 according to the first embodiment, the outer wall surface of the nozzle 433 of the channel member 430 and the outer wall surface of the chamber 434 are blackened as the blackened surface 432. However, only the outer wall surface of the nozzle 433 may be blackened as the blackened surface 432. In addition to the outer wall surface, an internal of the channel member 430 and an inner wall surface (channel side) of the channel member 430 may have high heat absorption property.

A black coating, such as a coating made of Okitsumo™ paint and the like, may be applied to the outer wall surfaces of the nozzle 433 and the chamber 434 to make the wall surface of the end portion 430*b* of the channel member 430 the blackened surface 432. Alternatively, a black sheet metal, for example, a sheet metal member blackened by alumite treatment may be used for the end portion 430*b* of the channel member 430.

Next, a temperature of the channel member 430 of the blower 421 and temperature distribution of the blowing temperature according to Comparative Example 1 is described below with reference to FIG. 8.

Figure 8:
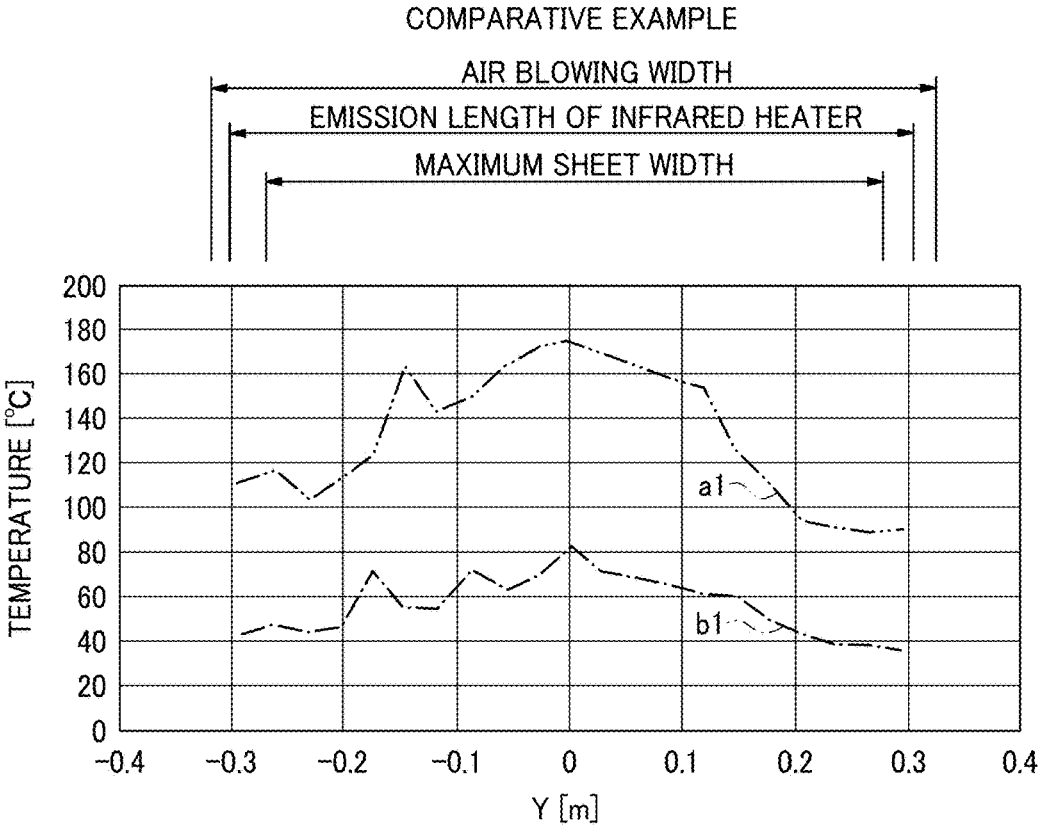
FIG. 8 is a graph illustrating temperature of the channel member of a blower and temperature distribution of blowing temperature according to Comparative Example 1.

FIG. 8 is a graph illustrating the temperature of the channel member 430 of the blower 421 and the temperature distribution of the blowing temperature according to Comparative Example 1.

In Comparative Example 1, unlike the present embodiment, a color of the outer wall surface of each of the end portions 430*b* of the channel member 430 in the longitudinal direction of the channel member 430 is a background color of the sheet metal member forming the channel member 430. The background color is a color that reflects infrared rays. The end portions 430*b* face the heater 422 of the channel member 430 of the blower 421

That is, in Comparative Example 1, heat absorption property of each of the end portions 430*b* in the longitudinal direction of the channel member 430 is made the same as the heat absorption property of the central portion 430*a* including a center of the channel member 430 in the longitudinal direction of the channel member 430. Each of the end portions 430*b* faces the heater 422 of the channel member 430.

In FIG. 8, a line "a1" indicates a temperature of the nozzle 433 of the channel member 430, and a line "b1" indicates the blowing temperature of air blown from the blowing port 431. "Y" represents a position of the channel member 430 in a direction from a central position toward both end portions 430*b* in the longitudinal direction of the channel member 430.

When the infrared irradiator 441 of the heater 422 of the heating device 402 irradiates the sheet P with infrared rays to heat the sheet P, the channel member 430 disposed near (proximate to) the heater 422 and facing the infrared irradiator 441 is also heated.

Therefore, even when the blower 421 itself does not include a heater, an inner space in the chamber 434 formed by the channel member 430 and a channel in the nozzle 433 are heated by the infrared irradiator 441 of the heater 422 of the heating device 402. Therefore, the air blown from the blowing port 431 of the nozzle 433 of the channel member 430 is also warmed.

At this time, in Comparative Example 1, the temperature of the channel member 430 and the temperature of the air blown from the blowing port 431 (blowing temperature) are high at the central portion 430*a* and low at the end portions 430*b* in the longitudinal direction of the channel member 430 as illustrated in FIG. 8.

In this example, a temperature of the central portion 430*a* of the channel member 430 is raised to about 180° C., but a temperature of the end portions 430*b* are lowered to about 90° C. The temperature of the air that passes through the channel of the channel member 430 and is blown from the blowing port 431 is 80° C. at the central portion 430*a* of the blowing port 431 and less than 40° C. at the end portions of the blowing port 431.

Reasons as described below causes such temperature distribution as described above. For example, the end portion 430*b* of the channel member 430 is close to outside air, and heat easily escapes. A path (distance) of the air taken in by the intake fan 435 in the channel member 430 is shorter at the end portion than at the central portion of the channel member 430. A heating time is shorter, and the infrared irradiator 441 itself has temperature distribution.

Here, the temperature distribution of the IR heater as the infrared irradiator 441 in the longitudinal direction of the IR heater is described below with reference to FIG. 9.

Figure 9:
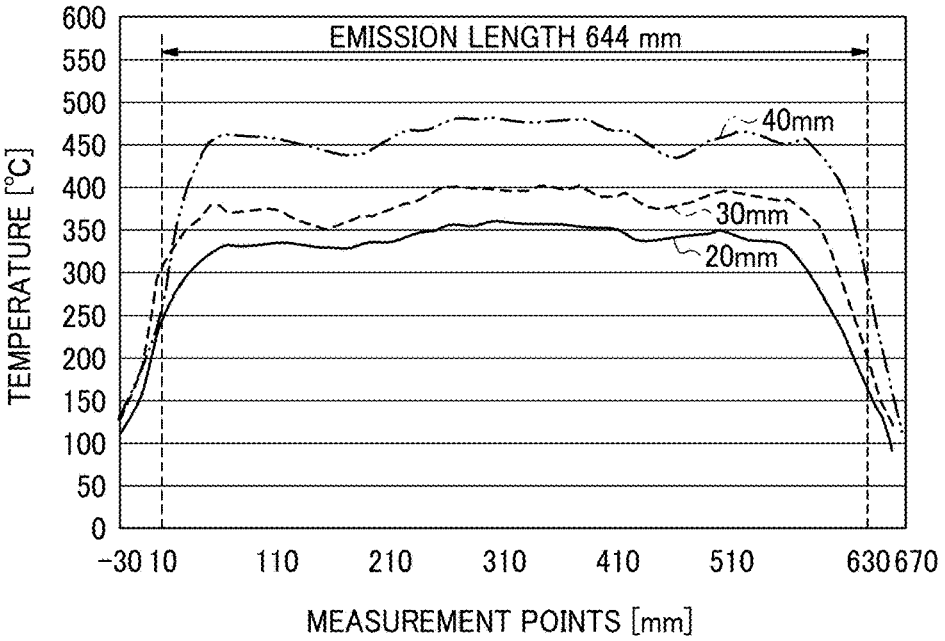
FIG. 9 is a graph illustrating the temperature distribution of an IR heater as the infrared irradiator in the longitudinal direction of the IR heater.

FIG. 9 is a graph illustrating the temperature distribution of the IR heater as the infrared irradiator 441 in the longitudinal direction of the IR heater.

FIG. 9 illustrates a result in which the temperature distribution is measured when a single heater having a light emission length of 644 mm is used. Further, a gypsum board is placed directly under the heater, and the distances from the heater surface to the gypsum board are set to 20 mm, 30 mm, and 40 mm.

As can be seen from the result illustrated in FIG. 9, the temperature of both end portions of the gypsum board is lower than the temperature of the central portion of the gypsum board at even in an interior of the emission length of 644 mm. Each of the end portions includes a region about 80 mm (40 mm×2). Above described "40 mm" indicates 40 mm from one of the end of the channel member 430.

Therefore, the sheet metal member adjacent to the heater has the same temperature distribution.

In the above case, if the emission length of the heater is sufficiently long, a uniform temperature range may be used. However, an increase in the emission length may not be desirable because longer emission length increases a size of the device and warms up unnecessary parts.

Next, an operational effect according to the first embodiment is described below with reference to FIG. 10.

Figure 10:
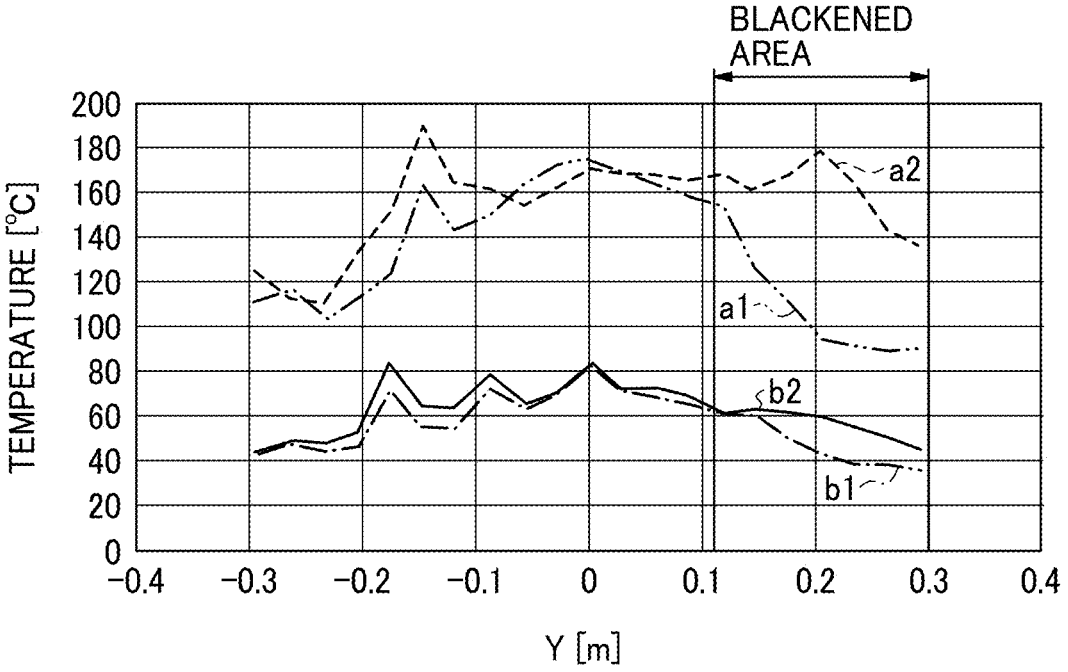
FIG. 10 is a graph illustrating temperature distribution of the outer wall surface the channel member of the blower and temperature distribution of the blowing temperature of the blower in the first embodiment of the present disclosure.

FIG. 10 is a graph illustrating the temperature distribution of the IR heater as the infrared irradiator 441 in the longitudinal direction of the IR heater.

FIG. 10 illustrates a temperature distribution of the temperature of the channel member 430 of the blower and the blowing temperature in the first embodiment of the present disclosure.

The dryer 400 according to the first embodiment includes the channel member 430, the outer wall surfaces of the end portions 430*b* of the channel member 430 in the longitudinal direction of the channel member 430 are blackened as the blackened surface 432 as described above with reference to FIG. 7. The outer wall surfaces of the end portions 430*b* (blackened surfaces 432) face the heater 422 of the channel member 430. Thus, the heat absorption property of the end portion 430*b* is made higher than the heat absorption property of the central portion 430*a* of the channel member 430 in the longitudinal direction of the channel member 430.

It is increased in an absorption amount of the infrared rays by the outer wall surface (blackened surface 432) of the end portion 430*b* of the channel member 430. Thus, the temperature of the end portion 430*b* of the channel member 430 becomes relatively higher than the temperature of the central portion 430*a* of the channel member 430.

As described above, the temperature of the end portion 430*b* of the channel member 430 is higher than the temperature of the central portion 430*a* of then channel member 430. The temperature of the air passing through the nozzle 433 is also higher at the end portion 430*b* than the central portion 430*a* of the channel member 430 in the longitudinal direction of the channel member 430.

That is, the end portion 430*b* of the channel member 430 is blackened as the blackened surface 432 according to the first embodiment. Thus, the temperature of the end portions 430*b* of the channel member 430 according to the first embodiment as indicated by the broken line "a2" in FIG. 10 becomes higher than the temperature of the end portions 430*b* in which the end portions 430*b* are not blackened (not forming the blackened surface 432) as illustrated in a chain double-dashed line "a1". Thus, the dryer 400 (channel member 430) can reduce variations in the temperature in the longitudinal direction of the channel member 430.

As a result, a rising temperature of the end portion 430*b* of the channel member 430 becomes higher than a rising temperature of the central portion 430*a* of the channel member 430. Therefore, as illustrated by a line "b2" in FIG. 10, the blowing temperature of the air blown from the blackened end portion 430*b* (blackened surface 432) in the longitudinal direction of the blowing port 431 becomes higher than the blowing temperature of the air blown from the end portion 430*b* of the channel member 430 that is not blackened as indicated by a line "b1" in FIG. 10. Thus, the end portion 430*b* is blackened surface 432 in the line b2, and the end portion 430*b* is not blackened surface 432 in the line b1. An area of the blackened surface 432 is indicated as "blackened area" in FIG. 10. Thus, the dryer 400 can reduce variations in the blowing temperature in the longitudinal direction of the blowing port 431.

In the above manner, only the end portion 430*b* in the longitudinal direction of the channel member 430 facing the heater 422 is blackened to form the blackened surface 432. Thus, the blackened surface 432 faces the heater 422. As a result, the dryer 400 can raise the temperature of only the portion at which the temperature has decreased to reduce variations in the blowing temperature.

It is efficient to perform blackening such as a black coating on an area exposed to infrared rays (thermal radiation). Also, it is efficient to perform blackening on a sheet metal member that forms the channel member 430 in contact with an air path (channel) of the blowing air. A part of the channel member 430 not functioning as an air path is not blackened to reflect infrared rays to reduce heat absorption.

If the entire channel member 430 is uniformly blackened, only a temperature in the longitudinal direction of the channel member 430 is raised overall. Thus, the variations in the blowing temperature are not reduced.

As described above, the heating device 402 according to the first embodiment includes the blower 421, the heater 422, and the channel member 430 to perform a blowing process as follows. The blower 421 blows air toward the sheet P, onto which the liquid has been applied and is conveyed. The heater 422 heats the sheet P that has been applied with a liquid and is conveyed. The channel member 430 faces the heaters 422. In the heating device 402, a temperature at the end portions 430*b* in the longitudinal direction of the channel member 430 is more easily fallen than the temperature fallen at the central portion 430*a* of the channel member 430. The heating device 402 has a configuration in which the blower 421 blows air toward the sheet P while the air flow through the channel member 430 as a channel. The heat absorption property at each of the end portions 430*b* is higher than the heat absorption property at the central portion 430*a* of the channel member 430 in the longitudinal direction of channel member 430.

Next, the heating device 402 according to a second embodiment of the present disclosure is described below with reference to FIGS. 11 and 12.

Figure 11:
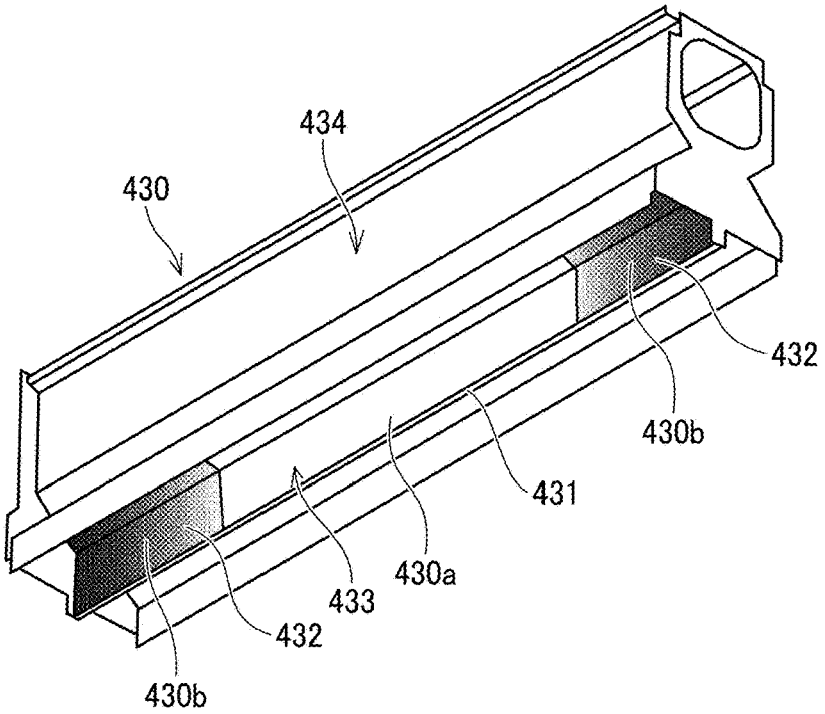
FIG. 11 is a schematic cross-sectional perspective view of the channel member of the heating device according to a second embodiment of the present disclosure.

FIG. 11 is a schematic cross-sectional perspective view of the channel member 430 of the heating device 402.

Figure 12:
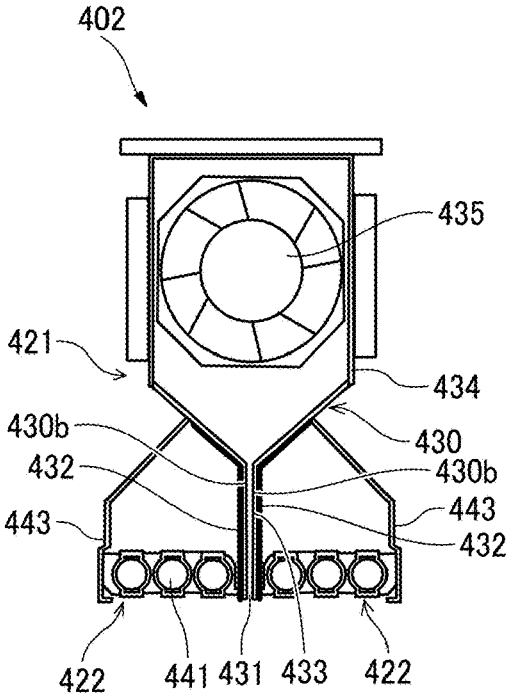
FIG. 12 is a schematic cross-sectional side view of the heating device according to the second embodiment of the present disclosure.

FIG. 12 is a schematic cross-sectional side view of the heating device 402 according to the second embodiment of the present disclosure.

The heating device 402 in the second embodiment has an outer wall surface of the end portion 430*b* of the channel member 430, the heat absorption property of which changes gradually or stepwise in a direction toward a center (central portion 430*a*) of the channel member 430. Specifically, a color of the blackened surface 432 of the end portion 430*b* of the channel member 430 is gradually thinned by applying gradation so that the color gradually changes to gray from the end portion 430*b* toward the central portion 430*a*.

As a result, the dryer 400 can increase the overall heat absorption property to improve a heating efficiency while reducing temperature variations.

The blackened surface 432 preferably has a black gradation (a gradation in the heat absorption property) so that the blackened surface 432 has a density difference in the longitudinal direction of the channel member 430 in a region exposed to infrared rays. The black gradation is formed in the blackened surface 432 to reduce variations in the temperature distribution of the blowing temperature from the blowing port 431 in the longitudinal direction of the channel member 430. The blackened surface 432 does not have a gradation in a height direction of the channel member 430 also in this second embodiment of the present disclosure.

Next, the heating device 402 according to a third embodiment of the present disclosure is described below with reference to FIGS. 13 and 14.

Figure 13:
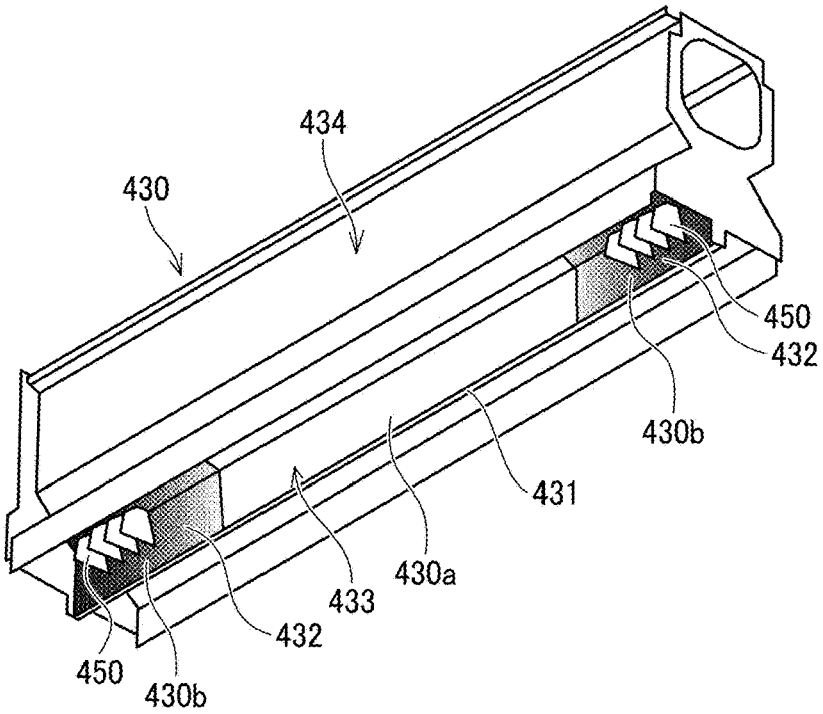
FIG. 13 is a schematic cross-sectional perspective view of the channel member of the heating device according to a third embodiment of the present disclosure.

FIG. 13 is a schematic perspective view of the channel member 430 of the heating device 402 according to the third embodiment of the present disclosure.

Figure 14:
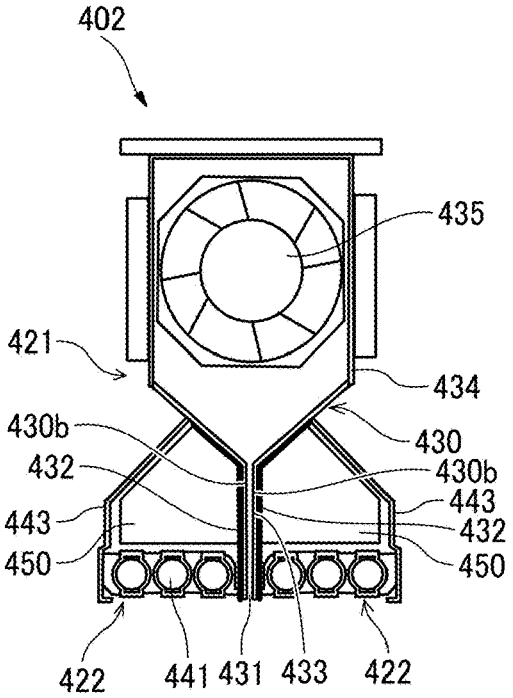
FIG. 14 is a schematic cross-sectional side view of the heating device according to the third embodiment of the present disclosure.

FIG. 14 is a schematic cross-sectional side view of the heating device 402 according to the second embodiment of the present disclosure.

In the dryer 400 according to the third embodiment, the channel member 430 includes a heat receiving member 450 at each of the end portions 430*b* of the channel member 430. The heat receiving members 450 may be one or more fins that receives heat from the infrared irradiator 441. The heat receiving member 450 is in contact with the end portion 430*b* of the channel member 430.

As a result, the dryer 400 can more efficiently increase the temperature at the end portion 430*b* of the channel member 430. That is, the dryer 400 can more efficiently increase the blowing temperature blown from the end portion 430*b* of the blowing port 431.

Next, the heating device 402 according to a fourth embodiment of the present disclosure is described below with reference to FIGS. 15 and 16.

Figure 15:
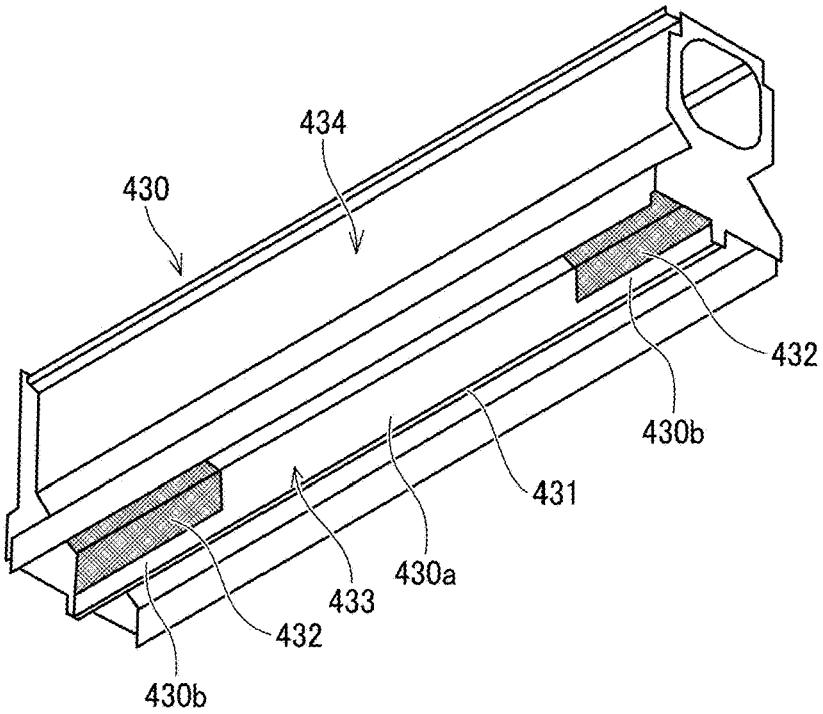
FIG. 15 is a schematic cross-sectional perspective view of the channel member of the heating device according to a fourth embodiment of the present disclosure.

FIG. 15 is a schematic perspective view of the channel member 430 of the heating device 402 according to the fourth embodiment of the present disclosure.

Figure 16:
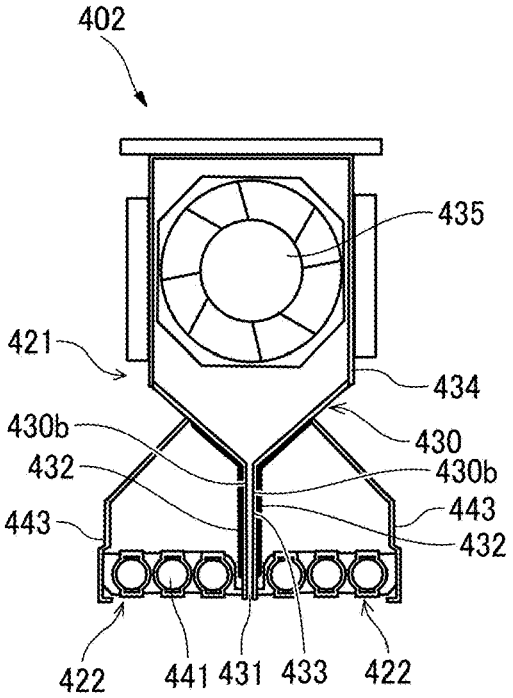
FIG. 16 is a schematic cross-sectional side view of the heating device according to the fourth embodiment of the present disclosure.

FIG. 16 is a schematic cross-sectional side view of the heating device 402 according to the fourth embodiment of the present disclosure.

The dryer 400 according to the third embodiment includes the blackened surface 432 formed in an outer wall surface of the end portion 430*b* of the channel member 430 except for a portion in a vicinity of (proximate to) the blowing port 431 of the nozzle 433. For example, a lower part of the end portion 430*b* of the channel member 430 near (proximate to) the blowing port 431 of the nozzle 433 is not blackened in FIG. 15.

As described above, the dryer 400 can obtain an effect of temperature rise to reduce variations in temperature in the longitudinal direction of the channel member 430 even when a part of the end portion 430*b* of the channel member 430 is not blackened.

In each of the above-described embodiments, the outer wall surface of the end portion 430*b* of the channel member 430 is blackened (including gradation) to increase the heat absorption property of the end portion 430*b* to be larger than the heat absorption property of the central portion 430*a*. However, the dryer 400 according to the present embodiment is not limited to the embodiments as described above. An inner wall surface of the end portion 430*b* of the channel member 430 may be treated to enhance the heat absorption property of the end portion 430*b*. Thus, the dryer 400 according to the above-described embodiments can reduce variations in the blowing temperature.

In the present embodiments, a "liquid" discharged from the head is not particularly limited as long as the liquid has a viscosity and surface tension of degrees dischargeable from the head. Preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for. e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

Examples of the "liquid discharge apparatus" include, not only apparatuses capable of discharging liquid on materials to which liquid can adhere, but also apparatuses to discharge a liquid toward gas or into a liquid.

The "liquid discharge apparatus" may include units to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material onto which liquid can adhere" represents a material on which liquid is at least temporarily adhered, a material on which liquid is adhered and fixed, or a material into which liquid is adhered to permeate.

Examples of the "material onto which liquid can adhere" include recording media, such as paper sheet, recording paper, recording sheet of paper, film, and cloth, electronic component, such as electronic substrate and piezoelectric element, and media, such as powder layer, organ model, and testing cell.

The "material on which liquid can adhere" includes any material on which liquid adheres unless particularly limited.

Examples of the "material on which liquid can adhere" include any materials on which liquid can adhere even temporarily, such as paper, thread, fiber, fabric, leather, metal, plastic, glass, wood, and ceramic.

The "liquid discharge apparatus" may be an apparatus to relatively move the head and a material on which liquid can adhere. However, the liquid discharge apparatus is not limited to such an apparatus.

For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on a sheet surface to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. A heating device comprising:

a blower configured to blow air, the blower comprising a channel member defining a channel of the air; and a heater disposed outside the channel member, wherein the channel member has end portions and a central portion in a longitudinal direction, each of the end portions having higher heat absorption property than the central portion, and said each of the end portions of the channel member faces the heater.

2. The heating device according to claim 1, wherein the channel member has an outer wall surface facing the heater, and heat absorption property of the outer wall surface of said each of the end portions is higher than heat absorption property of the outer wall surface of the central portion.

3. The heating device according to claim 1, wherein the blower includes an intake fan at each end of the channel member in the longitudinal direction of the channel member, and the intake fan generates an airflow flowing in the longitudinal direction in the channel member.

4. The heating device according to claim 1, wherein said each of the end portions of the channel member has the heat absorption property that changes gradually or stepwise in a direction toward the central portion.

5. The heating device according to claim 1, wherein the channel member includes a heat receiving member in contact with said each of the end portions of the channel member.

6. The heating device according to claim 5, wherein the heat receiving member includes one or more fins in contact with said each of the end portions of the channel member.

7. The heating device according to claim 1, wherein the channel member comprises a blowing port from which the air is blown, a longitudinal direction of the heater is coincident with the longitudinal direction of the channel member, and both of end positions of the blowing port are respectively disposed outside both end positions of a heat radiation region of the heater in the longitudinal direction of the channel member.

8. The heating device according to claim 1, wherein a longitudinal direction of the heater is coincident with the longitudinal direction of the channel member, and both end positions of a heat radiation region of the heater are respectively disposed outside both end positions of an object to be heated by the heater in the longitudinal direction of the channel member.

9. The heating device according to claim 1, wherein said each of the end portions of the channel member is blackened.

10. The heating device according to claim 1, wherein the channel member comprises a blowing port from which the air is blown; and said each of the end portions of the channel member is blackened except for a portion in a vicinity of the blowing port.

11. The heating device according to claim 1, wherein said each of the end portions of the channel member has a color that changes gradually or stepwise from black to gray toward the central portion.

12. A liquid discharge apparatus comprising:

a liquid discharge device configured to discharge a liquid onto a sheet; and the heating device according to claim 1, the heating device configured to heat the sheet, wherein the blower blows the air to the sheet onto which the liquid has been applied by the liquid discharge device, the heater heats the sheet to which the air is being blown by the blower, the channel member faces the heater, and the blower blows the air to the sheet through the channel member.

13. A printer comprising:

the liquid discharge device according to claim 12; and a conveyor configured to convey the sheet.

* * * * *